United States Patent [19]

Xigas

[11] Patent Number: 4,995,496

[45] Date of Patent: Feb. 26, 1991

[54] APPARATUS FOR PROTECTING AN EXTERNAL MECHANISM

[75] Inventor: Constantine Xigas, Dianella, Australia

[73] Assignee: Xigas Holdings Pty. Ltd., Dianella, Australia

[21] Appl. No.: 371,224

[22] Filed: Jun. 23, 1989

[30] Foreign Application Priority Data

Jun. 23, 1988 [AU] Australia ..... PI8933

[51] Int. Cl.[5] ..... G07F 9/00

[52] U.S. Cl. ..... 194/350

[58] Field of Search ..... 194/350

[56] References Cited

U.S. PATENT DOCUMENTS

| | | | |
|---|---|---|---|
| 3,297,123 | 1/1967 | Hutchins | 194/350 X |
| 3,774,742 | 11/1973 | Magnanelli | 194/346 X |
| 4,159,054 | 6/1979 | Yoshida | 194/350 |

FOREIGN PATENT DOCUMENTS

| | | | |
|---|---|---|---|
| 823990 | 9/1969 | Canada | 194/350 |

*Primary Examiner*—F. J. Bartuska

*Attorney, Agent, or Firm*—Fidelman & Wolffe

[57] ABSTRACT

An apparatus is disclosed for preventing entry into the coin receptacle of a washing or vending machine or the like by fracturing, as by stomping on, the coin insertion mechanism attached to and protruding from the coin receptacle.

3 Claims, 8 Drawing Sheets

APPARATUS FOR PROTECTING AN EXTERNAL MECHANISM

The present invention relates to an apparatus for protecting an external mechanism. External mechanisms, particularly coin insertion mechanisms found on the outside of various types of apparatus such as washing machines in laundrettes, vending machines and pool tables are prone to vandalism. In particular, these coin insertion mechanisms are often readily vandalised by being stomped on. This damages the mechanisms such that the vandals can steal coins from the coin receptable of the coin insertion mechanisms. The replacement of the damaged mechanisms is extremely expensive. Also, the damage to the coin insertion mechanisms makes the apparatuses unusable for a time.

Hitherto, the only way to inhibit the destruction of the coin mechanisms has been constantly to watch over all such mechanisms in the premises. This involves a wasteful and costly use of manpower which cannot protect the mechanisms during times of inattention of the part of the watcher. When the apparatus of the present invention is fitted to the external mechanisms of coin operated machines and devices and the like unauthorised persons are unable to move the external mechanism and thereby break into the coin receptable of the coin insertion mechanism.

In accordance with one aspect of the present invention there is provided an apparatus for protecting an external mechanism from damage which comprises plate means arranged for non-rotatable attachment to a housing, spacer means for spacing apart the plate means and supporting the external mechanism, and flange means attached to the plate means and arranged to overlay lateral portions of the external mechanism, such that the normal functions of the external mechanism is not inhibited.

Figure 1:
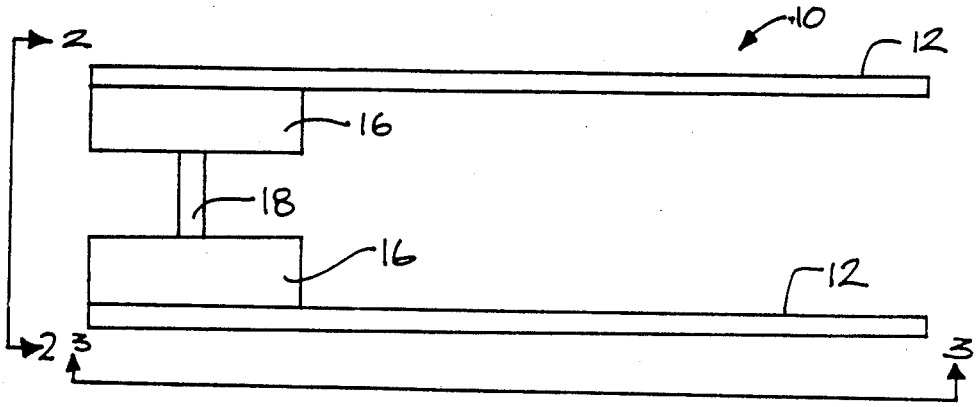
FIG. 1 is a plan view of one embodiment of an apparatus for protecting an external mechanism in accordance with the present invention.
Figure 3:
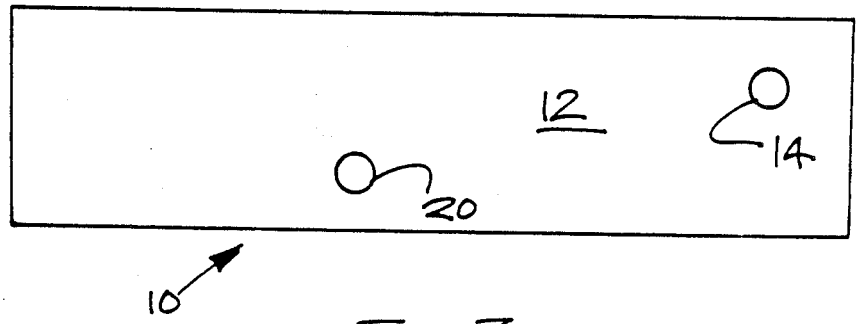
FIG. 3 is a side view along line 3—3 of the apparatus of FIG. 1.
Figure 4:
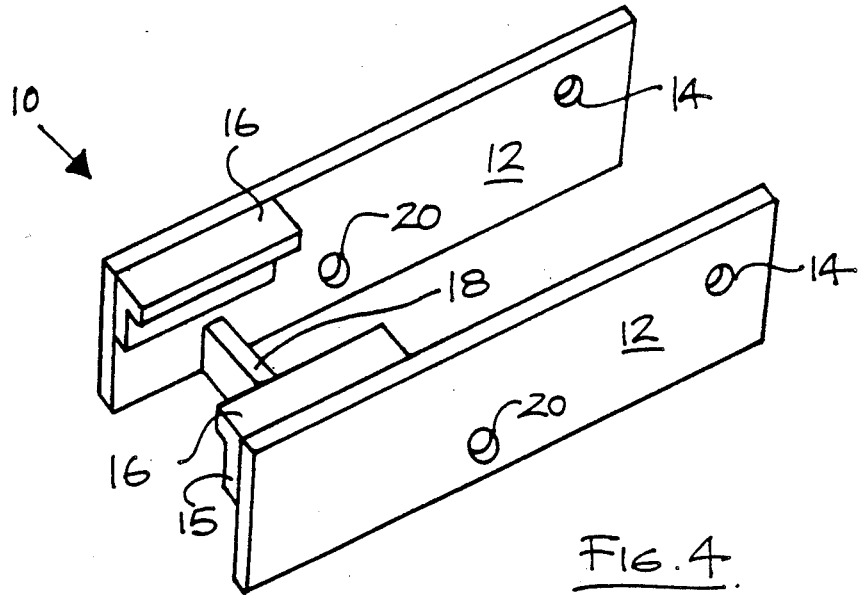
FIG. 4 is an upper perspective view of the apparatus of FIG. 1.

Shown in FIGS. 1 to 4, is an apparatus 10 for the protection of an external mechanism in accordance with the present invention. The apparatus 10 comprises a pair of spaced parallel flat plates 12 each having an aperture 14 located adjacent one end. At the opposite end of each plate is located an angle member 15. Each angle member 15 has a flange welded to the upper, inner face of the respective plate 12 at the said opposite end.

A further flange 16 of each angle member 15 projects towards the angle member 15 of the opposite plate 12. A spacer 18 extends between the inner faces of the plates 12 bolow the flanges 15. The spacer 18 is welded to the plates 12 and serves to secure the plates 12 together and to hold them apart by a predetermined distance.

Further, there is provided another aperture 20 intermediate the ends of each of the plates 12. Shown in FIGS. 5 and 6 is a second embodiment of the apparatus 10 of the present invention, like numerals denoting like parts.

Figure 5:
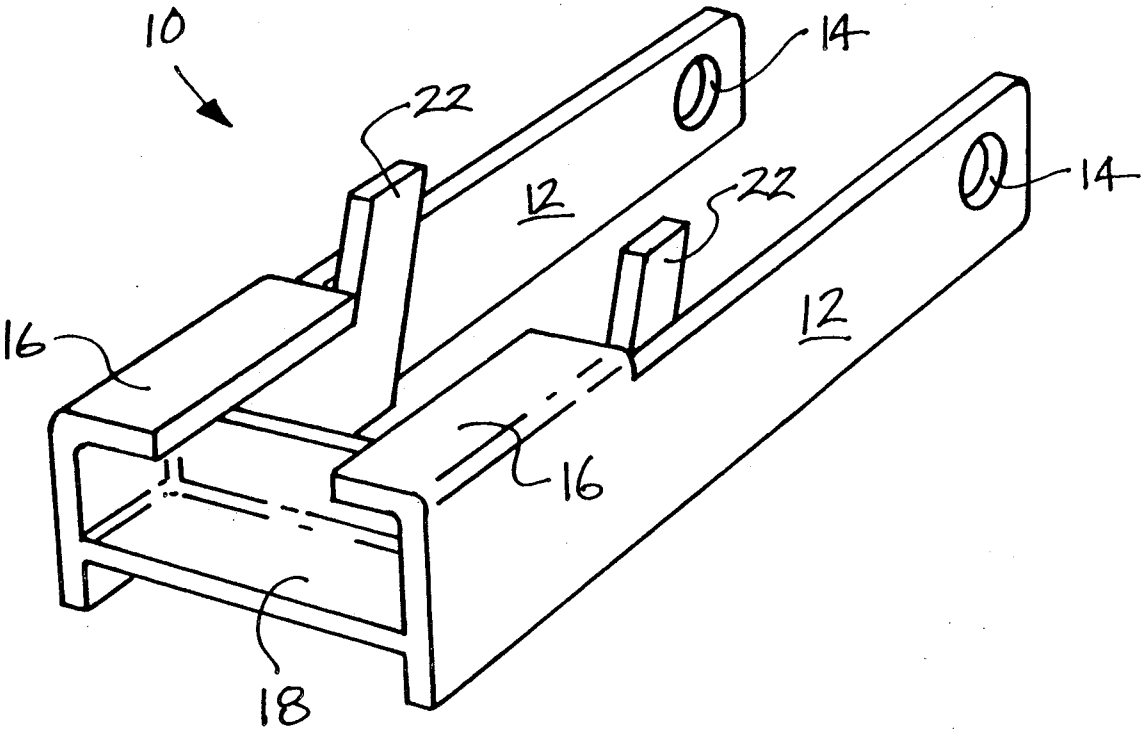
FIG. 5 is an upper perspective view of another embodiment of the apparatus of the present invention.
Figure 6:
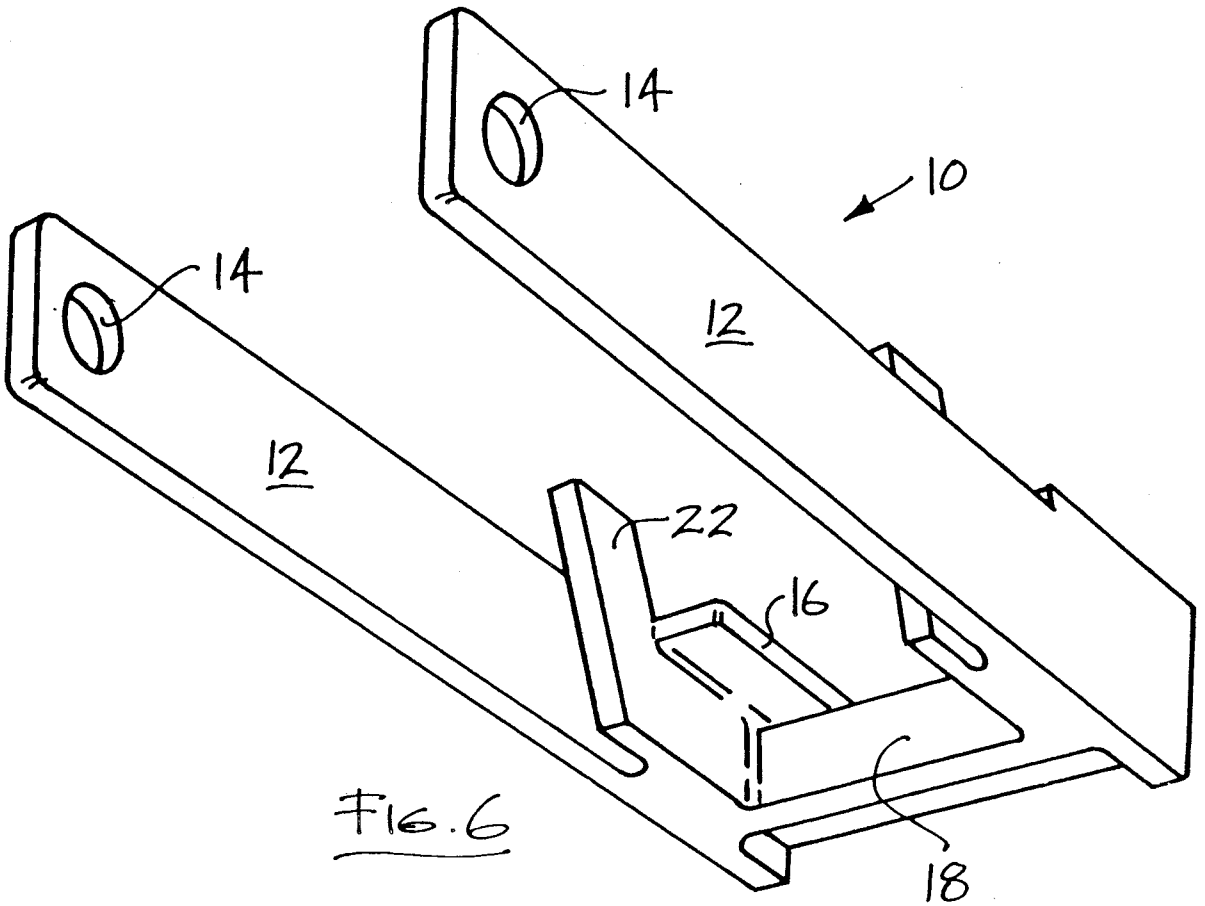
FIG. 6 is a lower perspective view of the apparatus of FIG. 5.

One difference between the embodiment of FIGS. 5 and 6 and the embodiment of FIGS. 1 to 4 is the omission of the apertures 20.

Figure 7:
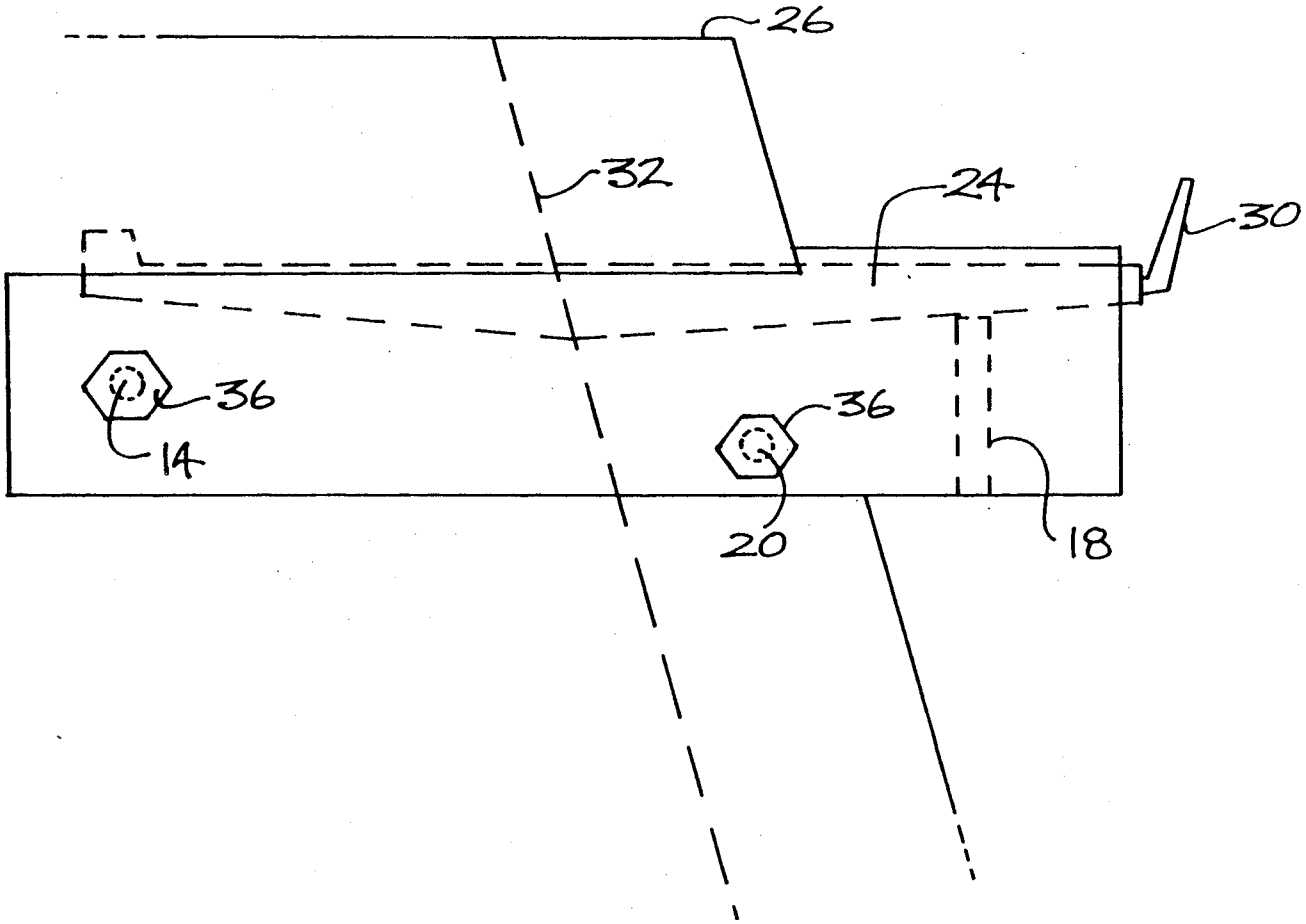
FIG. 7 is a side elevation of a housing having the apparatus of FIGS. 1 to 4 attached thereto.
Figure 8:
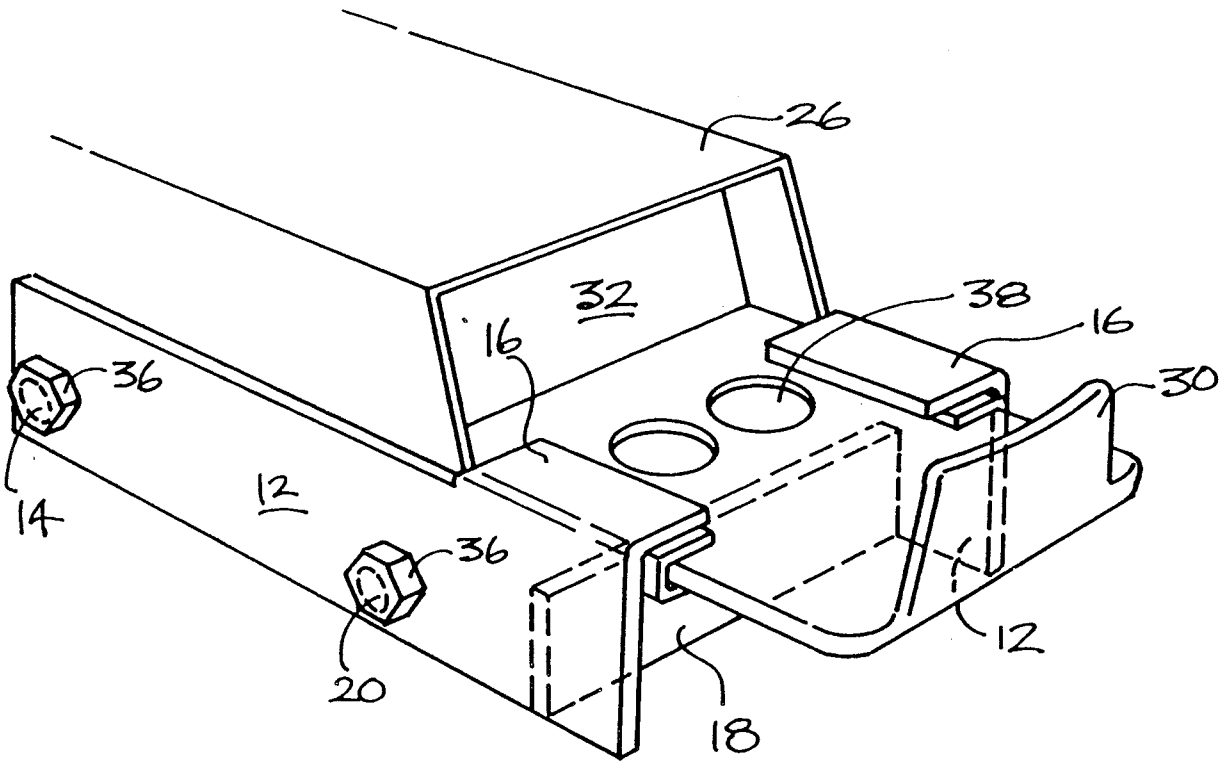
FIG. 8 is an upper perspective view of the housing of FIG. 7 with the apparatus attached thereto.

The embodiment shown in FIGS. 5 and 6 further comprises a sloping member 22 attached to each plate 12. Each sloping member 22 is located intermediate of the ends of the respective plate 12 and is mounted to the inner face of the respective plate 12. Preferably, the sloping member 22 makes an angle of approximately 10° to the vertical, when in use. Further each sloping member 22 extends beyond the upper edge of the respective plate 12. Still further, as shown in FIGS. 5 and 6, the flanges 16 are integrally formed with their plates 12 as are the sloping members 22. In use, the apparatus 10 of the present invention as exemplified in FIGS. 1 to 4, is attached to an external coin insertion mechanism 24 of a washing machine, vending machine or the like as shown in FIGS. 7 and 8. The coin insertion mechanism 24 of known type is attached to a housing 26 with a recessed front face 32.

The housing 26 contains a coin receptacle arranged to receive coins inserted into the housing through the coin insertion mechanism 24 in known manner.

The apparatus of the present invention is designed to fit over the coin insertion mechanism 24 and around the housing 26. The spacer 18 is so dimensioned that the coin insertion mechanism fits snugly between the two plates 12. Further, the flanges 16 overlay lateral portions of the coin insertion mechanism 24.

Figure 2:
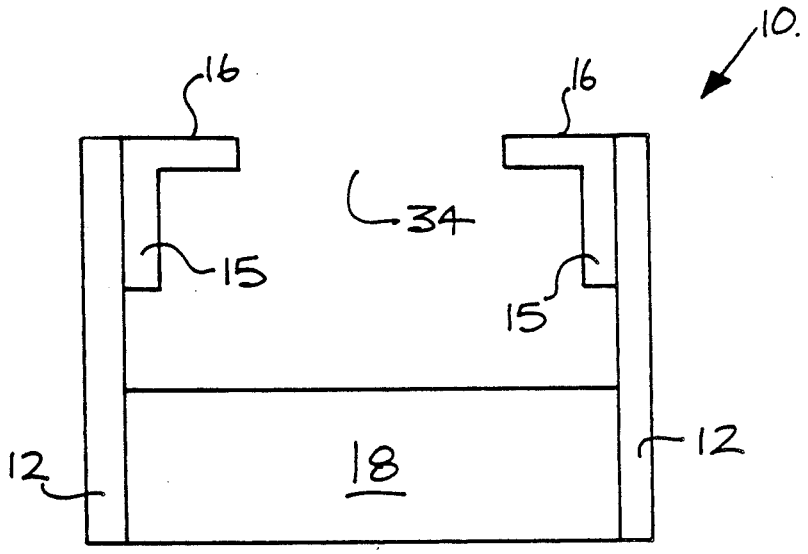
FIG. 2 is a frontal view along line 2—2 of the apparatus of FIG. 1.

The flanges 16 only extend partially across the gap between the plates 12 and a longitudinal slot 34 is defined by inner ends of the flanges 16 as seen FIGS. 2 and 7. The coin insertion mechanism 24 extends below the longitudinal slot 34. The holes 14 and 20 are then aligned with corresponding holes in sides of the housing of the washing machine. The holes 14 and 20 are then utilised to rigidly affix the apparatus 10 to the housing of the washing machine with bolts 36 or the like.

The flanges 16 partially cover the upper part of the coin insertion mechanism 24 while the spacer 18 supports the coin insertion mechanism 24 from below. The coin insertion mechanism 24 includes a reciprocably slidable tray 35 having an upwardly projecting handle 30 at its outer end. The slidable tray contains coin receiving apertures 38. The coin receiving apertures 38 of the coin insertion mechanism 24 are accessible to a user from the top. Normal functioning of the coin insertion mechanism 24 is not inhibited by the apparatus of the present invention. When the slidable tray 35 is pushed in so as to insert coins into the housing 26 to operate the machine the handle 30 passes through the slot 34.

Figure 9:
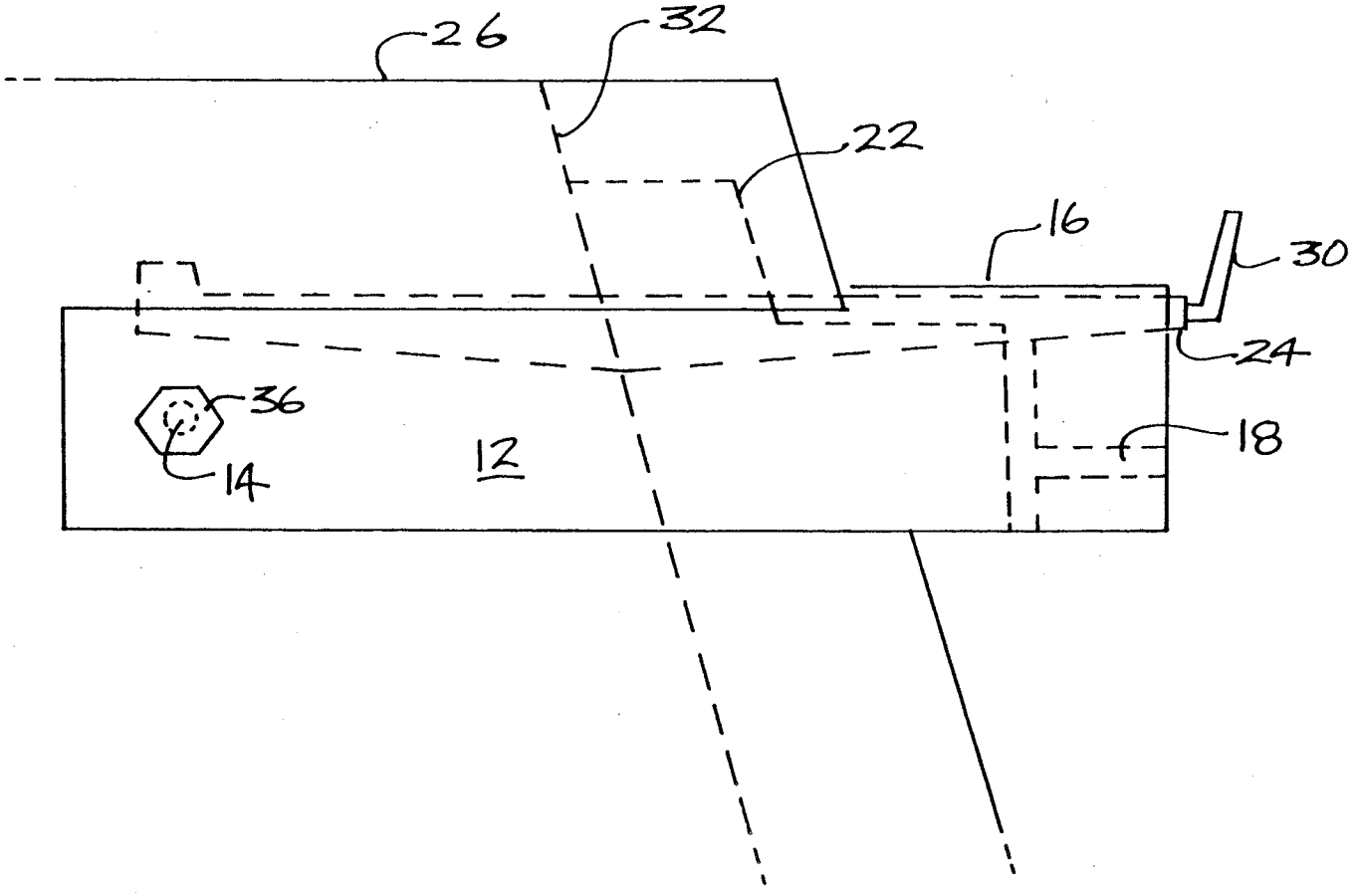
FIG. 9 is a side elevation of a housing with an apparatus according to FIGS. 5 and 6 attached thereto.
Figure 10:
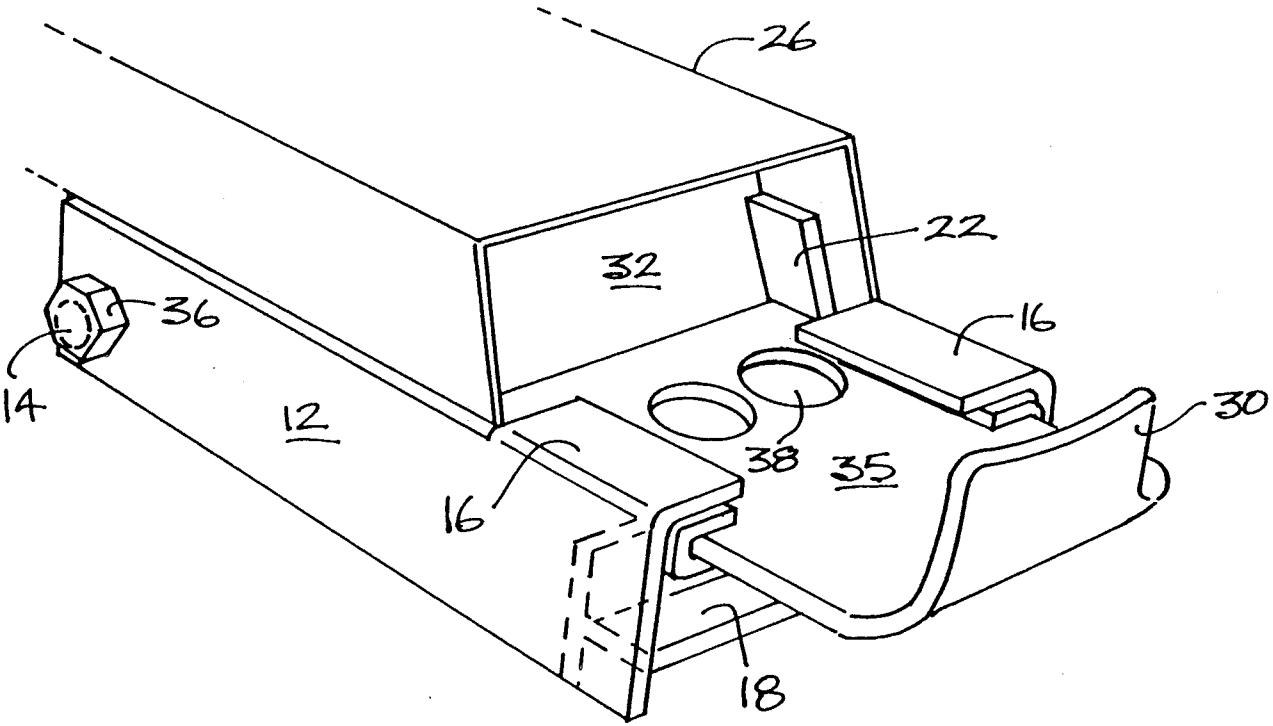
FIG. 10 is an upper perspective view of the housing of FIG. 9 with the apparatus attached thereto.

The apparatus of the present invention according to the alternative embodiment of FIGS. 5 and 6 is also arranged to be attached to an external coin insertion mechanism 24 of a washing machine in similar manner to the embodiment of FIGS. 1 to 4 as shown in FIGS. 9 and 10. The same reference numerals are used in FIGS. 9 and 10 as in FIGS. 7 and 8 to denote like parts. In this case, however, the apertures 20 are replaced by the sloping members 22.

The sloping members 22 are disposed such that they are located in use, externally of the housing 26 and bear against the front face 32 of the housing 26 of the coin receptable 28.

The angle of inclination of the sloping members 22 as discussed hereinbefore, has been found by the applicant to conform to a number of washing machines. The angle may obviously be varied to suit any other washing machines or devices equipped with similar coin insertion mechanism. The apparatus 10 is thus prevented from rotation about the apertures 14 by the slopping members 22.

In a further embodiment, the sloping members 22 of the embodiment of FIGS. 5 and 6 could be replaced by a plurality of pins of appropiate length to inhibit rotation of the apparatus 10 about the apertures 14. The coin insertion mechanism is then supported and restrained from motion in all directions by the apparatus of the present invention.

It is envisaged that the apparatus of the present invention would be of a sufficiently sturdy and robust construction in order to withstand, without failure, any loads likely to be applied by unauthorised persons. The apparatus of the present invention provides a cheap, cost effective means for constantly protecting an external mechanism from vandalism. The apparatus of the present invention may be cast from an appropriate material, preferably metal, or may be fabricated from proprietary metal sections.

Modifications and variations such as would be apparent to a skilled addressee are deemed within the scope of the present invention.

I claim:

1. An apparatus for protecting a coin insertion mechanism arranged to be attached to a housing having a front and a pair of sides with the coin insertion mechanism projecting from the front of the housing, said apparatus comprising a pair of spaced, substantially parallel flat plates each having respective, opposed first and second ends, said second ends spaced from said housing with a spacer extending between the plates adjacent the opposed second ends thereof so as to secure the plates together and to hold them apart by a predetermined distance, a respective flange on each plate located adjacent the second end thereof and projecting towards the flange on the opposed second end of the other plate a limited distance such that a slot is disposed between inner ends of the flanges, the spacer being spaced from and located below the flanges so that a coin insertion mechanism can be disposed between the plates below the flanges and above the spacer, the plates being provided with means arranged to fix rigidly the plates to the sides of the housing.

2. An apparatus according to claim 1, in which each plate is provided with a first aperture adjacent the first end thereof and a second apertute located intermediately of the first and second ends, the plates being arranged to be rigidly connected to the sides of the housing by fixing means interconnecting the first and second apertures with said sides.

3. An apparatus according to claim 1, in which each plate is provided with an apeture adjacent the first end thereof and a respective upwardly projecting member is affixed to an inner face of each plate, the plates being arranged to be rigidly connected to the sides of the housing by means of fixing means interconnecting the aperture with the said sides and by means of the upwardly projecting members engaging with the front face of the housing.

* * * * *